US011254128B2

(12) United States Patent
Kanzaki et al.

(10) Patent No.: US 11,254,128 B2
(45) Date of Patent: Feb. 22, 2022

(54) LIQUID DISCHARGING APPARATUS

(71) Applicant: Brother Kogyo Kabushiki Kaisha, Nagoya (JP)

(72) Inventors: Shotaro Kanzaki, Handa (JP); Toshihiro Kishigami, Obu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/011,475

(22) Filed: Sep. 3, 2020

(65) Prior Publication Data

US 2021/0060947 A1 Mar. 4, 2021

(30) Foreign Application Priority Data

Sep. 3, 2019 (JP) ..... JP2019-160109

(51) Int. Cl.
*B41J 2/14* (2006.01)

(52) U.S. Cl.
CPC ..... *B41J 2/14201* (2013.01); *B41J 2/1433* (2013.01); *B41J 2002/14306* (2013.01)

(58) Field of Classification Search
CPC ..... B41J 2/14201; B41J 2/1433; B41J 2002/14306; B41J 2/04581; B41J 2/04588; B41J 2002/14241; B41J 2/14233; B41J 2202/11
See application file for complete search history.

(56) References Cited

FOREIGN PATENT DOCUMENTS

JP 2009-285922 A 12/2009
JP 2014214754 A * 11/2014

OTHER PUBLICATIONS

IP.com search (Year: 2021).*

* cited by examiner

*Primary Examiner* — Lisa Solomon
(74) *Attorney, Agent, or Firm* — Banner & Witcoff, Ltd.

(57) ABSTRACT

A liquid discharging apparatus includes: a channel member formed with an individual channel, the individual channel including a nozzle and a pressure chamber; a piezoelectric element arranged in the channel member and facing the pressure chamber, the piezoelectric element being configured to apply pressure to liquid in the individual channel; and a driver configured to apply a driving signal to the piezoelectric element, the driving signal being constructed of a plurality of pulse waveforms, wherein the piezoelectric element is driven in a pull-strike system by one piece of the pulse waveforms such that the pressure chamber is depressurized and then pressurized.

7 Claims, 5 Drawing Sheets

Fig. 4

| DIAMETER OF NOZZLE (μm) | ATTENUATION COEFFICIENT | VELOCITY OF LIQUID DROPLET AT A TIME OF SATELLITE GENERATION (m/s) |
|---|---|---|
| 16.2 | 0.08 | 9.8 |
| 16.4 | 0.10 | 12.7 |
| 16.4 | 0.10 | 12.1 |
| 16.4 | 0.10 | 10.1 |
| 16.4 | 0.09 | 8.6 |
| 16.4 | 0.08 | 7.3 |
| 16.7 | 0.04 | 4.0 |
| 16.7 | 0.07 | 3.4 |
| 16.7 | 0.08 | 6.4 |
| 16.7 | 0.10 | 9.1 |
| 16.9 | 0.08 | 7.9 |
| 17.1 | 0.07 | 7.2 |
| 17.1 | 0.08 | 7.4 |
| 17.1 | 0.10 | 12.4 |
| 17.4 | 0.09 | 13.2 |
| 17.9 | 0.09 | 13.3 |
| 17.9 | 0.07 | 5.5 |
| 23.9 | 0.05 | 8.0 |
| 23.9 | 0.08 | 14.8 |
| 24.2 | 0.04 | 6.2 |
| 24.2 | 0.07 | 14.8 |
| 24.2 | 0.09 | 14.5 |
| 30.4 | 0.02 | 10.1 |
| 30.4 | 0.03 | 12.6 |

LIQUID DISCHARGING APPARATUS

CROSS REFERENCE TO RELATED APPLICATION

The present application claims priority from Japanese Patent Application No. 2019-160109, filed on Sep. 3, 2019, the disclosure of which is incorporated herein by reference in its entirety.

BACKGROUND

Field of the Invention

The present disclosure relates to a liquid discharging apparatus which discharges a liquid from a nozzle.

Description of the Related Art

In a liquid discharging head which discharges a droplet of a liquid (liquid droplet) from a nozzle, there are known various methods for suppressing generation of a minute liquid droplet which is referred to as a satellite, and which lands on a location around an original land position on which the liquid droplet is intended to land originally.

For example, Japanese Patent Application Laid-Open No. 2009-285922 discloses that in a driving signal which is to be supplied to a piezoelectric actuator of a liquid discharging head, a cancel pulse for suppressing the generation of satellite droplet is added after a discharge pulse for discharging the ink droplet.

SUMMARY

As the method for suppressing the generation of satellite droplet, there are also other methods exemplified by: lowering the discharge pressure itself for discharging the ink droplet; not superimposing discharge pressures, etc. However, in a case that the discharge pressure itself is lowered, there is such a possibility that the ink droplet might not be discharged. Further, in a case that the discharge pressures are not superimposed, the volume of the ink droplet which is discharged is small, and thus the head is required to be scanned a plurality of times in order to form a deep-colored dot, which in turn leads to such a possibility that a printing time might be increased.

An object of the present disclosure is to provide a channel structure, of a liquid discharging head, which is designed to be capable of suppressing the generation of satellite droplet while superimposing discharge pressures of the liquid droplet.

According to an aspect of the present invention, there is provided a liquid discharging apparatus including:

a channel member formed with an individual channel, the individual channel including a nozzle and a pressure chamber;

a piezoelectric element arranged in the channel member and facing the pressure chamber, the piezoelectric element being configured to apply pressure to liquid in the individual channel; and a driver configured to apply a driving signal to the piezoelectric element, the driving signal being constructed of a plurality of pulse waveforms, wherein the piezoelectric element is driven in a pull-strike system by one piece of the pulse waveforms such that the pressure chamber is depressurized and then pressurized, an expression: $\varphi\times0.92+\zeta\times167.51-20.75\geq Val$ is satisfied, provided that diameter of the nozzle is $\varphi$ μm, an attenuation coefficient of the individual channel is $\zeta$, and a droplet velocity in a case of discharging a liquid droplet from the nozzle at a length AL μs of a pulse waveform is Val m/s, the pulse waveform included in the plurality of pulse waveforms and most resonating with a resonance frequency of the individual channel, and the $\zeta$ is not more than 0.08.

The liquid discharging apparatus according to the aspect of the present disclosure is designed so that the expression: $\varphi\times0.92+\zeta\times167.51-20.75\geq Val$ is satisfied, provided that the diameter of the nozzle is $\varphi$ μm, the attenuation coefficient of the individual channel is $\zeta$, and the droplet velocity in a case that the liquid droplet is discharged from the nozzle at the length AL μs of the pulse waveform, which is included in the plurality of pulse waveforms and which most resonates with the resonance frequency of the individual channel, is Val m/s; and that the $\zeta$ is not more than 0.08. As a result, it is possible to suppress the generation of the satellite droplet while superimposing the discharge pressures of the liquid droplet.

BRIEF DESCRIPTION OF THE DRAWINGS

FIG. 4 is a table showing the result of experiment performed by the inventors of the present application.

DESCRIPTION OF THE EMBODIMENT

Figure 1:
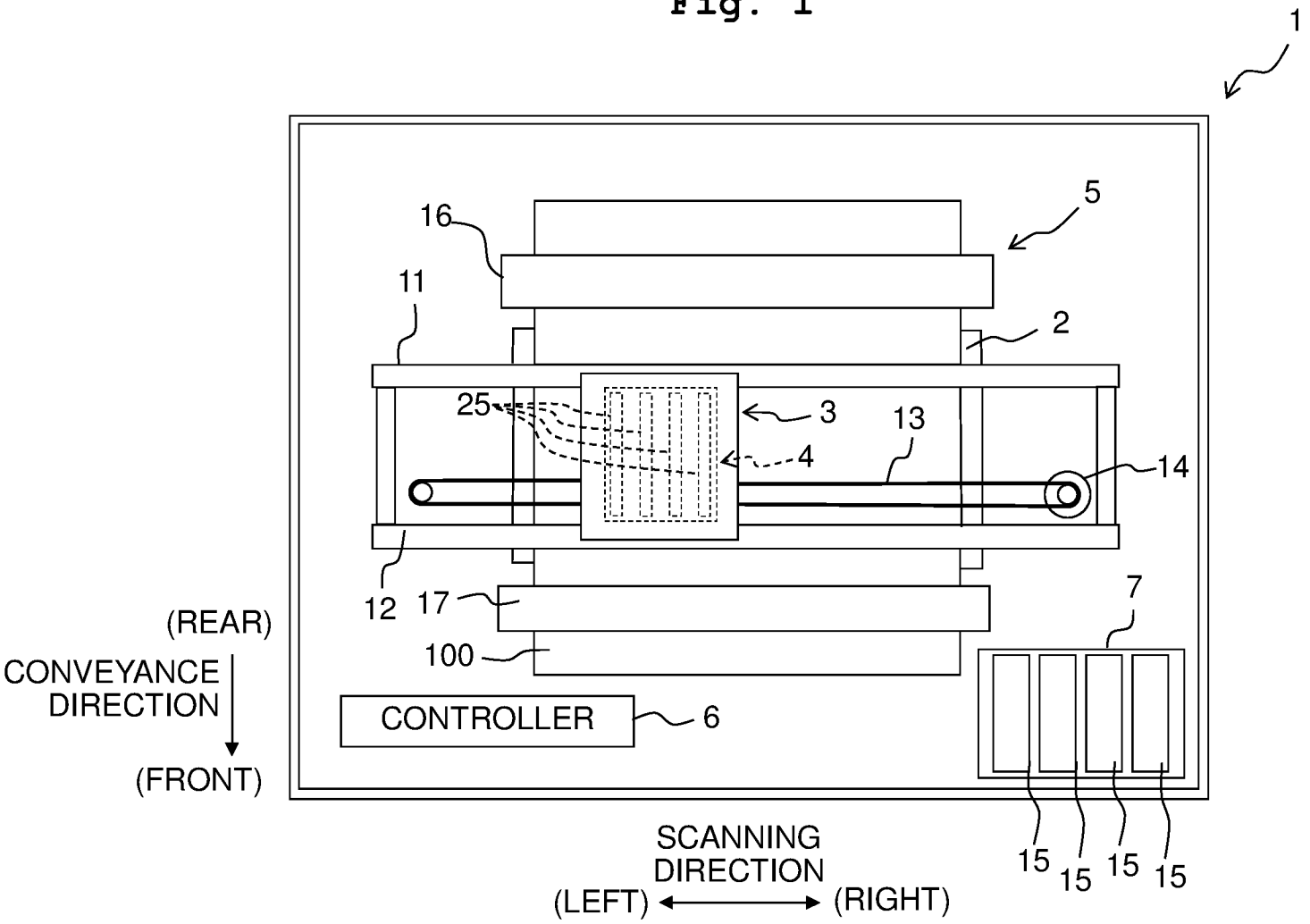
FIG. 1 is a schematic plan view of a printer according to an embodiment.

An embodiment of the present disclosure will be explained below. First, the schematic configuration of an ink-jet printer 1 will be explained, with reference to FIG. 1. Note that the respective directions of the front, rear, left and right depicted in FIG. 1 are defined as the "front", "rear", "left" and "right" of the printer. Further, the front side of the sheet surface of FIG. 1 is defined as "up" and the far side of the sheet surface of FIG. 1 is defined as "down". In the following description, the explanation will be given using the respective directional terms which are the front, rear, left, right, upper, and lower directions, as appropriate.

<Outline of Configuration of Ink-Jet Printer 1>

As depicted in FIG. 1, the ink-jet printer 1 is mainly provided with a platen 2, a carriage 3, an ink-jet head 4, a conveying mechanism 5, and a controller 6.

A recording paper (recording paper sheet, recording sheet) 100, which is a recording medium, is placed on the upper surface of the platen 2. The carriage 3 is configured to be reciprocable in a left-right direction (hereinafter referred also to as a scanning direction) along two guide rails 11 and 12 in an area facing the platen 2. An endless belt 13 is connected to the carriage 3. In a case that the endless belt 13 is driven by a carriage driving motor 14, the carriage 3 is moved in the scanning direction.

The ink-jet head 4 is attached to the carriage 3 and moves in the scanning direction, together with the carriage 3. The ink-jet head 4 is equipped with four head units 25 which are arranged side by side in the scanning direction. The four head units 25 are connected, by tubes (not depicted in the drawings), respectively, to a cartridge holder 7 to which four ink cartridges 15 are mounted or attached. Inks of four colors (black, yellow, cyan, and magenta) are stored in the four ink cartridges 15, respectively. Each of the four head unit 25 has a plurality of nozzles 30 (see FIG. 2) formed on a lower surface thereof (a surface on the far side of the sheet surface of FIG. 1). The plurality of nozzles 30 of each of the four head units 25 discharge one color ink, among the four color inks, which is supplied from any one of the four ink cartridges 15, toward the recording sheet 100 placed on the platen 2.

The conveying mechanism 5 has two conveying rollers 16, 17 which are arranged so as to sandwich the platen 2 therebetween in a front-rear direction. The conveying mechanism 5 conveys the recording sheet 100 placed on the platens 2 frontward (hereinafter also referred to as a conveyance direction) by the two conveying rollers 16, 17.

The controller 6 includes a ROM (Read Only Memory), a RAM (Random Access Memory), an ASIC (Application Specific Integrated Circuit) including a variety of kinds of control circuits, etc. The controller 6 executes a variety of kinds of processings such as printing on the recording sheet 100, etc., by using the ASIC and in accordance with a program(s) stored in the ROM. For example, in the printing processing, the controller 6 controls the ink-jet head 4, the carriage driving motor 14, a conveying motor (not depicted in the drawings) of the conveying mechanism 5, etc., so as to print an image, etc., on the recording sheet 100, based on a printing instruction or printing command inputted from an external apparatus such as a PC, etc. Specifically, the controller 6 alternately perform an ink discharging operation of discharging the ink(s) from the plurality of nozzles 30 of the four head units 25 while moving the ink-jet head 4 in the scanning direction together with the carriage 3, and a conveying operation of conveying the recording sheet 100 in a predetermined amount in the conveyance direction by the conveying rollers 16 and 17.

<Head Unit 25>

Next, the configuration of the head unit 25 will be explained in detail. Since the four head units 25 have a same configuration, one head unit 25, among the four head units 25, will be explained below.

Figure 2:
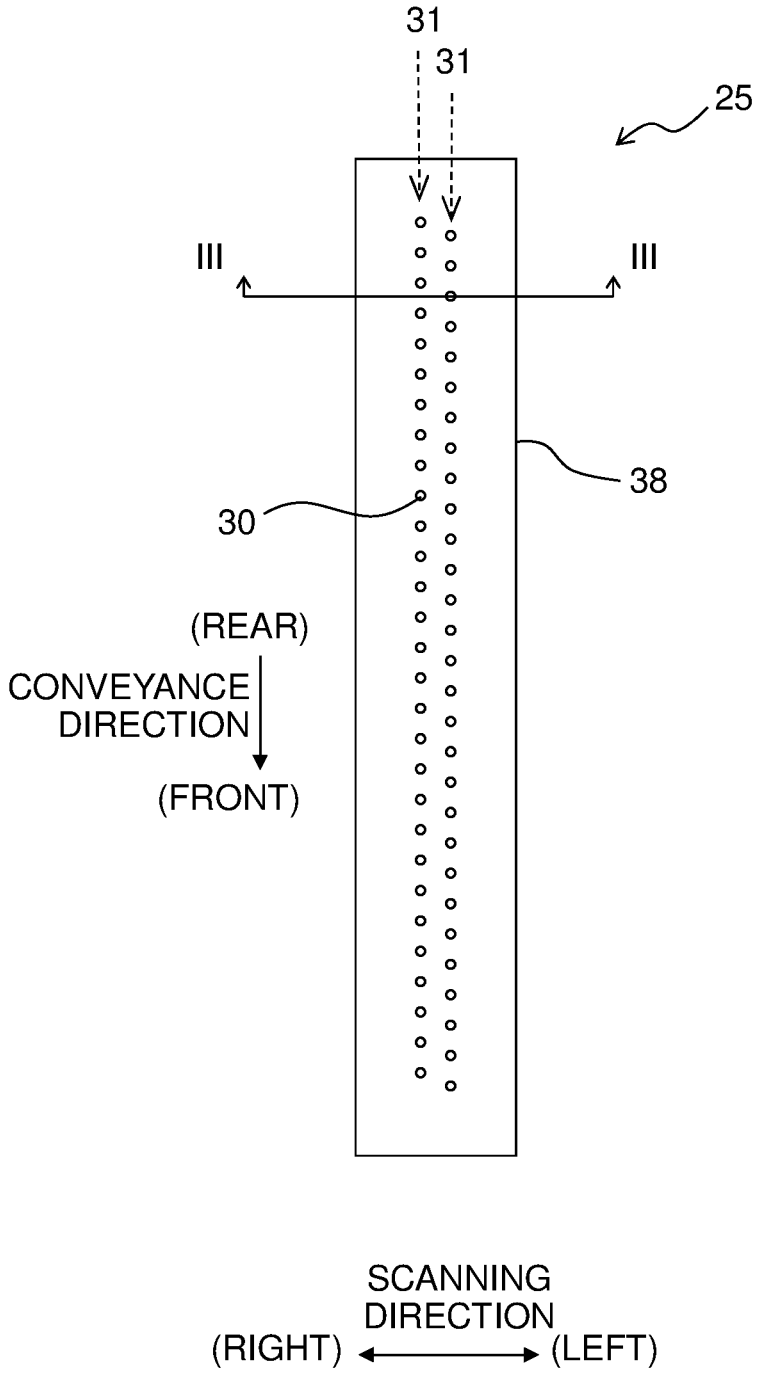
FIG. 2 is a bottom view of a head unit according to the embodiment.

As depicted in FIG. 2, the head unit 25 is long (elongated) in the conveyance direction and has an outer shape which is substantially rectangular in a plan view. Discharge ports of the plurality of nozzles 30 are formed in the lower surface of the head unit 25. On the lower surface of the head unit 25, the plurality of nozzles 30 construct two nozzle rows 31 which are arranged side by side in the scanning direction. Each of the nozzle rows 31 extends in the conveyance direction.

An ink supply port is formed in an end part in the conveyance direction of the head unit 25. The ink supply port is connected to any one of the four ink cartridges 15 (see FIG. 1) via a tube (not depicted in the drawings).

The head unit 25 includes a first channel substrate 36, a second channel substrate 37, a nozzle plate 38, a plurality of piezoelectric elements 39, a protective member 40, a vibration plate 45, etc. The vibration plate 45, the first channel substrate 36, the second channel substrate 37, and the nozzle plate 38 are combined so as to collectively correspond to an example of a "channel member" of the present disclosure. Further, the first the channel substrate 36 and the second channel substrate 37 are combined so as to collectively correspond to an example of a "channel plate" of the present disclosure.

The first channel substrate 36 is a substrate which is formed, for example, of a metal such as stainless steel (SUS). The first channel substrate 36 has a plurality of pressure chambers 41 which are formed in the first channel substrate 36 and which correspond to the plurality of nozzles 30, respectively. The plurality of pressure chambers 41 construct two rows of pressure chambers 41 arranged side by side in the scanning direction. The two rows of pressure chambers 41 each extend in the conveyance direction. Each of the plurality of pressure chambers 41 extends in the scanning direction and penetrates through the first channel substrate 36 in the up-down direction. The vibration plate 45 covering the plurality of pressure chambers 41 is joined to the upper surface of the first channel substrate 36 by an adhesive. The vibration plate 45 is made, for example, of a metal such as stainless steel (SUS), and is arranged on the entirety of the upper surface of the first channel substrate 36. Note that the upper surface of the vibration plate 45 is insulated by an insulating film (not depicted in the drawings).

The second channel substrate 37 is a substrate which is made, for example, of a metal such as stainless steel (SUS), and is joined to a lower surface of the first channel substrate 36 by an adhesive. The second channel substrate 37 has two manifolds 42 which are formed therein and which communicate with the ink supply port. The ink in one of the ink cartridges 15 (see FIG. 1) is supplied to the two manifolds 42 via the tube and the ink supply port.

Figure 3:
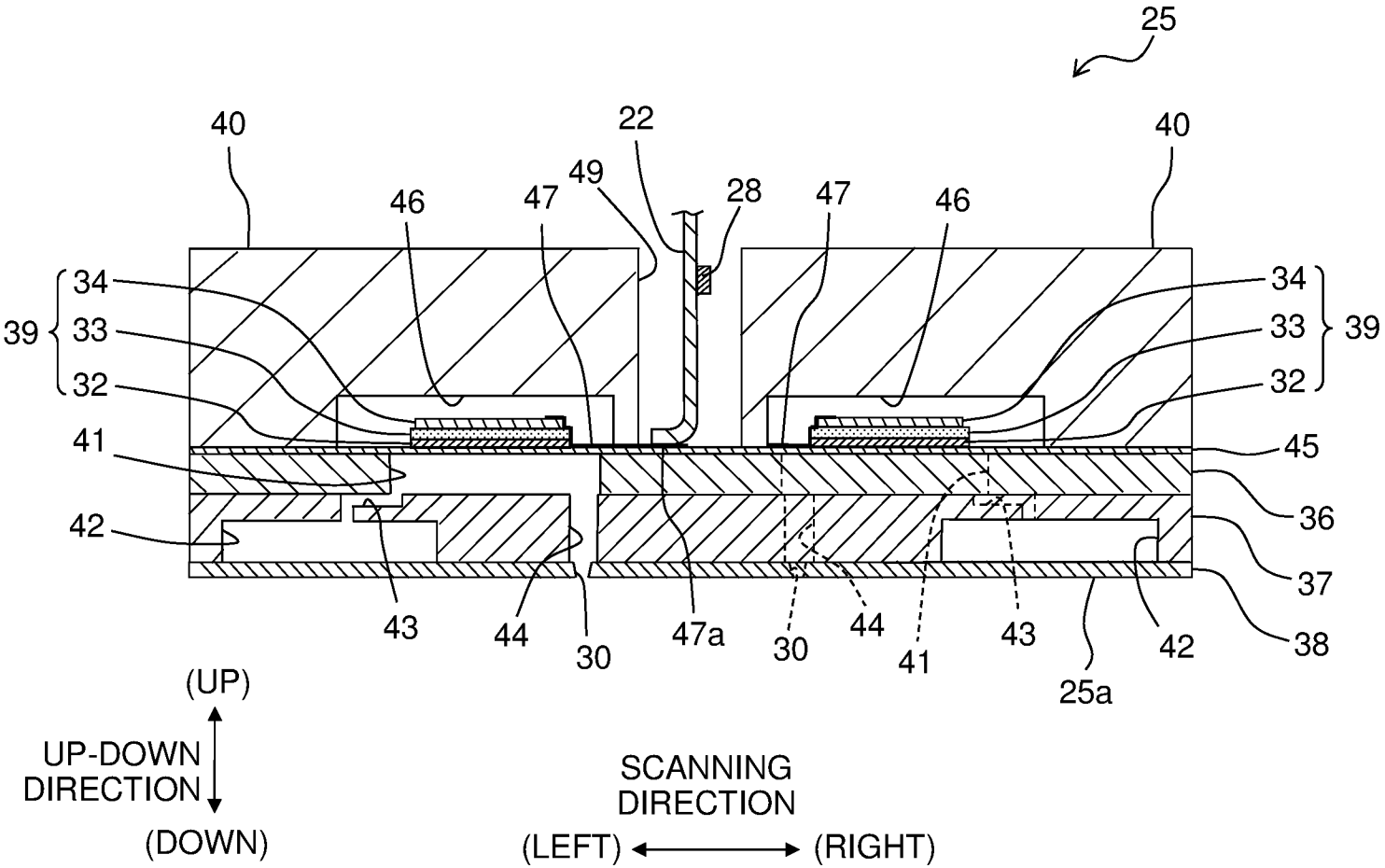
FIG. 3 is a cross-sectional view of FIG. 2, taken along a line in FIG. 2.

Each of the two manifolds 42 extends in the conveyance direction (a direction perpendicular to the sheet surface of FIG. 3) at an area, of the second channel substrate 37, which overlaps in the up-down direction with the pressure chambers 41 formed in the first channel substrate 36. A lower end of each of the two manifolds 42 is covered by the nozzle plate 38.

The second channel substrate 37 further includes a plurality of throttle channels 43 each of which communicates the manifold 42 and one of the plurality of pressure chambers 41, and a plurality of descenders 44 each of which communicates one of the plurality of pressure chambers 41 and one of the plurality of nozzles 30 formed in the nozzle plate 38, respectively.

Each of the plurality of throttle channels 43 is formed by performing half-etching for the upper surface of the second channel substrate 37. Each of the plurality of throttle channels 43 has one end connected to one of the plurality of pressure chambers 41 and the other end connected to the manifold 42. The plurality of descenders 44 construct two rows of descenders 44 arranged side by side in the scanning direction. Each of the two rows of descenders 44 extends in the conveyance direction. Each of the plurality of descenders 44 penetrates through the second channel substrate 37 in the up-down direction. Each of the plurality of descenders 44 has one end connected to one of the plurality of pressure chambers 41 and the other end connected to one of the plurality of nozzles 30. Note that the channel resistance of each of the plurality of descenders 44 is designed to be smaller than the channel resistance of one of the plurality of throttle channels 43 corresponding thereto. Each of the plurality of descenders 44 is an example of a "first channel" of the present disclosure, and each of the plurality of throttle channels 43 is an example of a "second channel" of the present disclosure. Further note that each of the plurality of nozzles 30, one of the plurality of descenders 44 connected to each of the plurality of nozzles 30, one of the plurality of pressure chambers 41 connected to one of the plurality of descenders 44, and one of the plurality of throttle channels 43 connected to one of the plurality of pressure chambers 41 are an example of an "individual channel" of the present disclosure.

The nozzle plate 38 is a plate made, for example, of polyimide, and has rigidity which is lower than those of the first channel substrate 36 and the second channel substrate 37. The nozzle plate 38 is joined to the lower surface of the second channel substrate 37 by an adhesive. The plurality of nozzles 30 aligned in the conveyance direction is formed in the nozzle plate 38. As described above, the plurality of nozzles 30 construct the two nozzle rows 31 (see FIG. 2). Each of the plurality of nozzles 30 communicates with one of the plurality of pressure chambers 41 corresponding thereto and formed in the first channel substrate 36, via one of the plurality of descenders 44 formed in the second channel substrate 37. Note that the shape of a discharge port of each of the plurality of nozzles 30 is preferably circular.

Two common electrodes 32 are formed in the upper surface of the vibration plate 45 so as to overlap with the two rows of the pressure chambers 41, respectively. Each of the two common electrodes 32 extend in the conveyance direction. Each of the two common electrodes 32 is made, for example, of platinum (Pt).

Two piezoelectric layers 33 are formed in the upper surfaces of the two common electrodes 32, respectively. Each of the two piezoelectric layers 33 also extends in the conveyance direction, in a similar manner to the two common electrodes 32. Each of the two piezoelectric layers 33 is made, for example, of lead zirconate titanate (PZT).

A plurality of individual electrodes 34 are formed in the upper surface of each of the two piezoelectric layers 33. Further, each of the plurality of individual electrodes 34 overlaps, in the up-down direction, with pressure chambers 41, among the plurality of pressure chambers 41, which construct one of the two rows of the pressure chambers 41 corresponding thereto. Each of the plurality of individual electrodes 34 has a substantially rectangular outer shape which is elongated in the scanning direction. Each of the plurality of individual electrodes 34 is made, for example, of iridium (Ir).

As described above, the two common electrodes 32, the two piezoelectric layers 33, and the plurality of individual electrodes 34 are stacked on the upper surface of the vibration plate 45, thereby forming the plurality of piezoelectric elements 39 facing the plurality of pressure chambers 41, respectively. In other words, the plurality of piezoelectric elements 39 form two rows of the piezoelectric elements 39 overlapping, in the up-down direction, with the two rows of the pressure chambers 41, respectively. Each of the plurality of piezoelectric elements 39 is constructed of one piece of the plurality of individual electrodes 34, one piece of the two piezoelectric layers 33, and one piece of the two common electrodes 32.

A plurality of driving traces 47 configured to supply a predetermined driving signal are connected to the plurality of individual electrodes 34, respectively. Each of the plurality of driving traces 47 is drawn from one of the plurality of piezoelectric elements 39 up to an area between the two rows of the piezoelectric elements 39. Ends, of the plurality of driving traces 47, on a side opposite to the plurality of individual electrodes 34 are made to be a plurality of drive contacts 47*a* to which a COF 22 (to be described later on) is connected. The plurality of drive contacts 47*a* of the plurality of driving traces 47 are aligned in the conveyance direction at the area, on the upper surface of the vibration plate 45, which is located between the two rows of the piezoelectric elements 39. The plurality of driving traces 47 are formed, for example, of a metal such as gold (Au).

The protective member 40 is joined to the upper surface of the vibration plate 45 by the adhesive. Two recessed parts (sunken parts or concave parts) 46 covering the two rows of the piezoelectric elements 39, respectively, are formed on the lower surface of the protective member 40. The protective member 40 is provided for purposes such as, of shielding the plurality of piezoelectric elements 39 from the outside air, and preventing the plurality of piezoelectric elements 39 from having any contact with moisture, etc. The two recessed parts 46 are arranged side by side in the scanning direction and each extend in the conveyance direction. Further, a through hole 49 penetrating through the protective member 40 in the up-down direction is formed in a central part in the scanning direction and the conveyance direction of the protective member 40. The through hole 49 is formed between the two recessed parts 46 in the scanning direction and extends in the conveyance direction. The plurality of drive contacts 47*a* formed in the upper surface of the vibration plate 45 are exposed from the through hole 49.

A COF (Chip On Film) 22 which is a tracing member having a plurality of traces is joined to each of the four head units 25. To provide a more specific explanation, the COF 22 is inserted through the through hole 49 formed in the protective member 40, and a forward end part, of the COF 22, expanding along the upper surface of the vibration plate 45 is joined to the upper surface of the vibration plate 45 by the adhesive. With this, the plurality of traces of the COF 22 and the plurality of driving traces 47 are electrically connected, respectively, via the plurality of drive contacts 47*a* which are exposed from the through hole 49.

A driver IC 28 connected to the plurality of the traces is mounted on the COF 22. Although not depicted in the drawings, the other end of COF 22 is connected to the controller 6 (see FIG. 1) of the ink-jet printer 1. The driver IC 28 generates a driving signal for driving the plurality of piezoelectric elements 39 based on a control signal from the controllers 6. The driving signal generated by the driver IC 28 is supplied to the plurality of piezoelectric elements 39 via the plurality of traces of COF 22 and the plurality of drive contacts 47*a*. The potential of the two common electrodes 32 is maintained at the ground potential. In a case that the driving signal is supplied, the potential of each of the plurality of individual electrodes 34 is changed between a predetermined driving potential and the ground potential. Each of the four head units 25 and the driver IC 28 are combined so as to collectively correspond to an example of a "liquid discharging apparatus" of the present disclosure.

In a case that the potential of a certain individual electrode 34, among the plurality of individual electrodes 34, is changed from the ground potential to the driving potential, any potential difference is generated between the certain individual electrode 34 and the common electrode 32. With this, an electric field parallel to a direction of the thickness (thickness direction) of the piezoelectric layer 33 acts on a part, of the piezoelectric layer 33, which is sandwiched between the certain individual electrode 34 and the common electrode 32 (hereinafter, referred to as an "active part"). In this situation, a direction of the polarization (polarization direction) of the active part (the thickness direction of the piezoelectric layer 33) and the direction of the electric field are coincident to each other, thereby allowing the active part to extend in the thickness direction of the piezoelectric layer 33, and to be compressed in a direction of the plane (plane direction) of the piezoelectric layer 33. Accompanying with the compressive deformation of the active part, parts or portions, of the piezoelectric element 39 and the vibration plate 45, respectively, which face a certain pressure chamber 41, among the plurality of pressure chamber 41 and corresponding to the certain individual electrode 34, is deformed so as to project toward the certain pressure chamber 41.

An explanation will be given about a driving procedure, which is a so-called pull-strike system, of the piezoelectric element 39 in the present embodiment. Firstly, the potential of the individual electrode 34 is made to be the driving potential in advance. Further, each time a discharge request is given, the potential of the individual electrode 34 is made to be the ground potential which is same as that of the common electrode 32, and then the potential of the individual electrode 34 is made to be the driving potential again at a predetermined timing. According to the above described driving procedure, at the timing at which the potential of the individual electrode 34 is made to be the ground potential, the piezoelectric layer 33 returns to its original shape, and the volume of the pressure chamber 41 is increased as compared with an initial state (a state in which the potential of the individual electrode 34 and the potential of the common electrode 32 are different). Under the condition that the volume of the pressure chamber 41 is increased as compared with the initial state, the inside of the pressure chamber 41 is allowed to have a negative pressure, and the ink is sucked into the pressure chamber 41 from the manifold 42. Afterwards, the piezoelectric layer 33 is deformed so as to project toward the pressure chamber 41 at a timing at which the potential of the individual electrode 34 is allowed to be the driving potential again. At this time, the volume of the pressure chamber 41 is decreased to thereby make the pressure inside the pressure chamber 41 to become the positive pressure, which in turn increase the pressure applied to the ink, thereby discharging the ink droplet from the puzzle 30. Namely, in order to discharge the ink droplet, a driving signal including a pulse of which reference is the driving potential is supplied to individual electrode 34.

In this situation, the pulse width of the driving signal is ideally AL (Acoustic Length). AL is the time length during which a pressure wave generated in the pressure chamber 41 propagates from the manifold 42 to the nozzle 30. In this case, in a case that the pressure inside the pressure chamber 41 is reversed from the negative pressure to the positive pressure, both of the negative and positive pressures are combined, thereby making it possible to discharge the ink droplet at a stronger pressure.

Further, in a case of discharging the ink droplet continuously a plurality of times, it is generally preferred that an interval between pulses supplied for discharging the ink droplet is made to be the AL. With this, the period of a residual pressure wave of the pressure generated in a case of discharging a previously discharged ink droplet and the period of a pressure wave of the pressure generated in a case of discharging a later discharged ink droplet are coincident to each other, and these periods are superimposed to each other to thereby make it possible to amplify the pressure for discharging the ink droplet.

Figure 5:
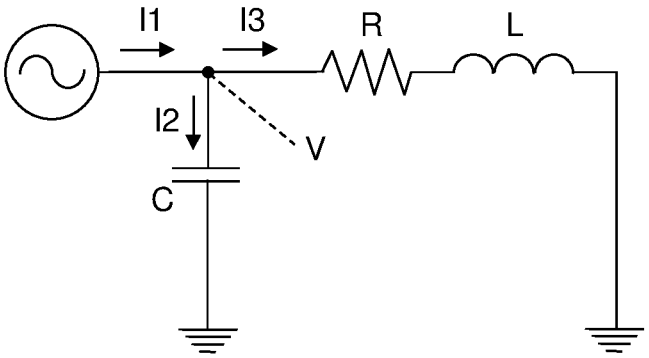
FIG. 5 is a circuit diagram which is substantially equivalent to the head unit according to the embodiment.

Next, an experiment conducted by the inventors of the present application will be explained, with reference to FIGS. 4 to 6.

Firstly, a plurality of kinds of individual channels having mutually different nozzle diameters and attenuation coefficients were prepared, as depicted in FIG. 4. Note that each of the individual channels is constructed of one of the nozzles 30, one of the descenders 44 connected to the nozzle 30, one of the pressure chambers 41 connected to the descender 44, and one of the throttle channels 43 connected to the pressure chamber 41. Further, the driving signal was applied twice to the piezoelectric element 39 corresponding to each of the individual channels to thereby cause ink droplets to be discharged continuously a plurality of times from the nozzle 30 included in each of the individual channels; the flying velocity of each of the ink droplets was measured; and it was confirmed whether or not a satellite droplet was generated. Note that the pulse width and the pulse interval in the driving signal were made to be both AL (μs). In addition, the piezoelectric element 39 corresponding to each of the individual channels was driven by the above-described pull-strike system. Further, regarding each of the individual channels, the driving voltage of the driving signal was raised by a predetermined voltage, until the generation of satellite droplet was confirmed. The liquid droplet velocity (m/s) at the time of the generation of satellite (satellite generation) in FIG. 4 represents the flying velocity of a first droplet (leading droplet) of a plurality of ink droplets discharged or ejected at a point of time at which the generation of the satellite droplet was confirmed. Namely, this means that in a case that the flying velocity of the leading droplet, among the plurality of ink droplets, was smaller than the value depicted in FIG. 4, no satellite droplet is generated, and that in a case that the flying velocity of the leading droplet is greater than the value depicted in FIG. 4, a satellite droplet is generated.

Further, the attenuation coefficient of each of the individual channels was calculated by a procedure described as follows. Firstly, the sizes (dimensions) of the nozzle 30, the descender 44, the pressure chamber 41, and the throttle channel 43 included in each of the individual channels were measured. Next, from the measured sizes, the resistance, inertance, and compliance were calculated for each of the nozzle 30, the descender 44, the pressure chamber 41, and the throttle channel 43. Then, since each of the four head units 25 is substantially equivalent to a RLC direct circuit depicted in FIG. 5, a formula of the RLC series circuit indicated by the following formula (1) was applied so as to calculate an attenuation coefficient ζ. In this situation, the compliance indicated in FIG. 5 represents a synthetic compliance around the pressure chamber 41. Further, the resistance and inertance represent a synthetic resistance and a synthetic inertance of the throttle channel 43 and the descender 44.

$$\zeta = \tfrac{1}{2} * R * (C/L)^{1/2} \quad (1)$$

Note that as a result of the calculation by the above-described formula (1), the value of the attenuation coefficient ζ was dispersed in a range of 0.02 to 0.10 as indicated in FIG. 4; however, in a case that the attenuation coefficient ζ is high, the pressure is rapidly attenuated, and thus the volume of the ink droplet discharged from the nozzle becomes to be small, which results in a decrease in the printing efficiency. For this reason, as the channel design of the individual channel, it is preferred that the value of ζ is not more than 0.08.

Figure 6:
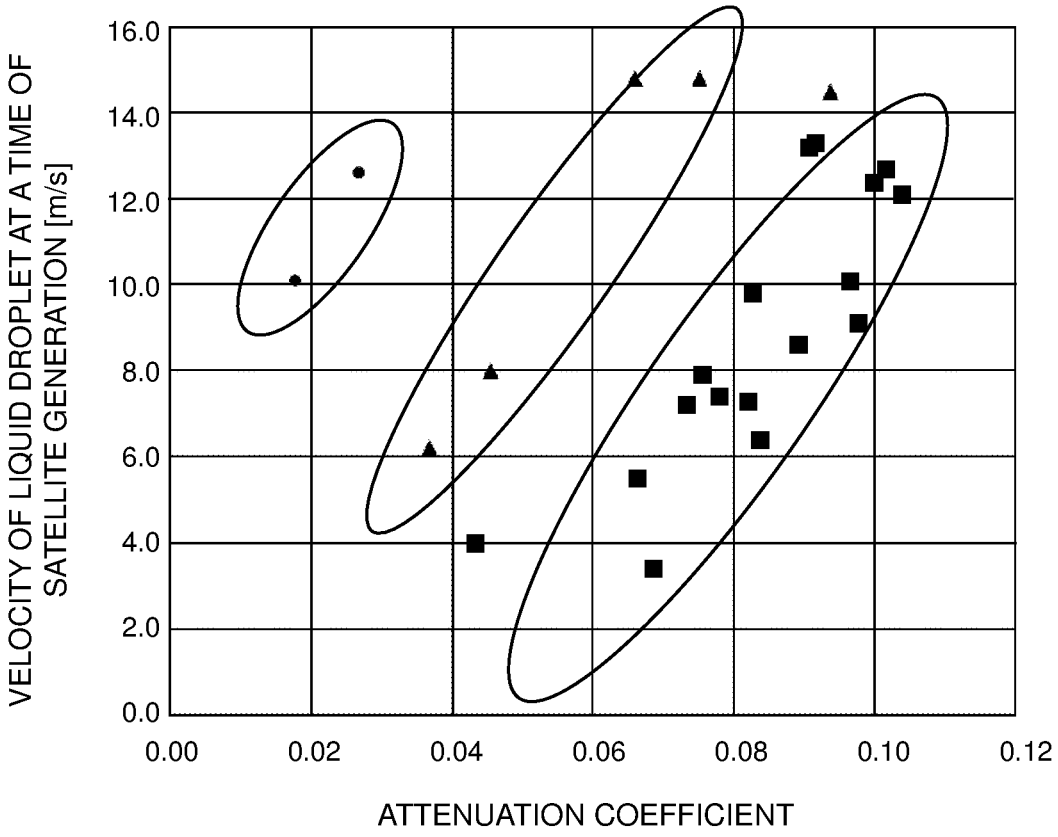
FIG. 6 is a graph corresponding to the table of FIG. 4.

Further, a graph in FIG. 6 indicates the attenuation coefficient at each of the individual channels and the average value of the flying velocity of the ink droplet in a case that the generation of satellite droplet was confirmed. Note that the data represented by squares in FIG. 6 corresponds to data with a nozzle diameter in a range of 16.2 (μm) to 17.9 (μm) in FIG. 4. The data represented by triangles in FIG. 6 corresponds to data with a nozzle diameter of 23.9 (μm) or 24.2 (μm) in FIG. 4. The data represented by circles in FIG. 6 corresponds to data with a nozzle diameter of 30.4 (μm) in FIG. 4.

Further, these pieces of the data were subjected to the multiple regression analyses, with a liquid droplet velocity $V_{AL}$ (m/s) at the time of the satellite generation, a nozzle diameter φ (μm), and the attenuation coefficient as ζ a response variable y, a predictor variable $x_1$, and a predictor variable $x_2$, respectively. As a result, a formula (2) as indicated below was obtained. Further, the coefficient of determination was approximately 0.78.

$$V_{AL}=\varphi*0.92+\zeta*167.51-20.75 \quad (2)$$

From the above-described result of the experiment, the inventors of the present application have obtained the following knowledge that, in order to suppress the generation of satellite droplet in a certain individual channel among the plurality of individual channels, it is only necessary to satisfy a formula (3) as described below, provided that the diameter of the nozzle is φ (μm), the attenuation coefficient is ζ, and the velocity of the ink droplet velocity in a case that the ink droplet is discharged from the nozzle at the length AL (μs) of the pulse waveform, which is included in the plurality of pulse waveforms and which most resonates with the resonance frequency of the individual channel, is $V_{AL}$ (m/s).

$$V_{AL}\leq\varphi*0.92+\zeta*167.51-20.75 \quad (3)$$

In the embodiment of the present disclosure as explained above, the discharge port of each of the nozzles 30 is circular. Accordingly, the surface tension acting on the meniscus becomes uniform, as compared with a case wherein the discharge port has a rectangular shape or an elliptical shape, and thus the generation of satellite droplet is suppressed.

In the above-described embodiment, the vibration plate 45, the first channel substrate 36, the second channel substrate 37, and the nozzle plate 38 are joined to one another by the adhesive. For this reason, the damping effect by the adhesive is provided, and the pressure can be effectively damped or attenuated.

In the above-described embodiment, in each of the individual channels, the throttle channel 43 is connected to the upstream side of the pressure chamber 41, and the descender 44 is connected to the downstream side of the pressure chamber 41. Further, the channel resistance of the descender 44 is smaller than the channel resistance of the throttle channel 43. Therefore, it is possible to efficiently impart the discharge energy to the ink, while effectively attenuating the pressure generated in the pressure chamber 41.

In the above-described embodiment, the rigidity of the nozzle plate 38 is lower than the rigidity of each of the first channel substrate 36 and second the channel substrate 37. Therefore, the pressure generated in the pressure chamber 41 can be effectively attenuated by the damping effect of the nozzle plate 38.

In the above-described embodiment, the throttle channel 43 is formed by performing the half-etching for the second channel substrate 37. Therefore, the frictional coefficient of the inner wall surface of the throttle channel 43 is increased, thereby making it possible to increase the channel resistance of the throttle the channel 43.

Although the embodiment of the present disclosure has been explained in the foregoing, the present disclosure is not limited to or restricted by the above-described embodiment, and various design changes can be made within the scope of the claims.

In the above-described experiment conducted by the inventors of the present disclosure, the sizes of the nozzle 30, the descender 44, the pressure chamber 41, and the throttle channel 43 were measured, and the attenuation coefficient was calculated based on the measured sizes and the formula of the RLC series circuit. However, the present disclosure is not limited to this. For example, the attenuation coefficient may be obtained by using a simulator.

In the above-described embodiment, the ink-jet printer 1 performs printing on the recording sheet 100 by a so-called serial head system in which the ink-jet head 4 is moved in the width direction of the sheet by the carriage 3. It is allowable, however, that the ink-jet printer 1 performs printing on the recording sheet 100 by a so-called line head system in which the ink is discharged from a head unit which is fixed with respect to the ink-jet printer 1 and which is elongated in the width direction of the sheet.

In the above-described embodiment, the present disclosure is applied to the ink-jet head configured to print an image, etc., by ejecting the ink(s) onto a recording sheet. However, the present disclosure is also applicable to liquid discharging apparatuses which are usable in a variety of kinds of usages, other than the printing of an image, etc. For example, the present disclosure is also applicable to a liquid discharging apparatus configured to discharge a conductive liquid onto a substrate so as to form a conductive pattern on a surface of the substrate, etc.

What is claimed is:

1. A liquid discharging apparatus comprising:

a channel member formed with an individual channel, the individual channel including a nozzle and a pressure chamber;

a piezoelectric element arranged in the channel member and facing the pressure chamber, the piezoelectric element being configured to apply pressure to liquid in the individual channel; and a driver configured to apply a driving signal to the piezoelectric element, the driving signal being constructed of a plurality of pulse waveforms, wherein the piezoelectric element is driven in a pull-strike system by one piece of the pulse waveforms such that the pressure chamber is depressurized and then pressurized, an expression: $\varphi\times0.92+\zeta\times167.51-20.75\geq Val$ is satisfied, provided that diameter of the nozzle is φ μm, an attenuation coefficient of the individual channel is ζ, and a droplet velocity in a case of discharging a liquid droplet from the nozzle at a length AL μs of a pulse waveform is Val m/s, the pulse waveform included in the plurality of pulse waveforms and most resonating with a resonance frequency of the individual channel, and the ζ is not more than 0.08.

2. The liquid discharging apparatus according to claim 1, wherein a shape of an opening of the nozzle is circular.

3. The liquid discharging apparatus according to claim 1, wherein the channel member is formed of a plurality of plates joined to each other by an adhesive.

4. The liquid discharging apparatus according to claim 1, wherein the individual channel further includes at least one of:

a first channel having one end connected to the pressure chamber, and another end connected to the nozzle; and a second channel having one end connected to the pressure chamber and another end not connected to the nozzle.

5. The liquid discharging apparatus according to claim 4, wherein the individual channel includes both of the first channel and the second channel, and channel resistance of the first channel is smaller than channel resistance of the second channel.

6. The liquid discharging apparatus according to claim 1, wherein the channel member includes a nozzle plate formed with the nozzle, and a channel plate formed of a material different from a material of the nozzle plate, the channel plate being joined to the nozzle plate, and rigidity of the nozzle plate is smaller than rigidity of the channel plate.

7. The liquid discharging apparatus according to claim 3, wherein at least a part of the individual channel is formed by performing half-etching for any of the plates.

* * * * *